US005255809A

United States Patent [19]

Ervin et al.

[11] Patent Number: 5,255,809

[45] Date of Patent: Oct. 26, 1993

[54] COMPRESSED GAS CONTAINER WITH SHAPE MEMORY ALLOY PRESSURE RELIEF MEMBER

[75] Inventors: Paul R. Ervin, Dearborn; Ronald C. Malec, Northville; Alan J. Porter, Livonia, all of Mich.

[73] Assignee: Ford Motor Company, Dearborn, Mich.

[21] Appl. No.: 61,945

[22] Filed: May 17, 1993

[51] Int. Cl.[5] ..... B65D 51/16

[52] U.S. Cl. ..... 220/89.1; 220/209; 220/201; 137/843

[58] Field of Search ..... 220/89.1, 89.2, 89.3, 220/201; 137/843, 844, 849, 852

[56] References Cited

U.S. PATENT DOCUMENTS

| | | | |
|---|---|---|---|
| 2,589,144 | 3/1952 | Russuell et al. | 220/89.1 |
| 2,673,660 | 3/1954 | Nordin | 220/89.1 |
| 3,712,501 | 1/1973 | Morano et al. | 220/89.1 |
| 4,660,714 | 4/1987 | Suzuki et al. | 206/0.6 |
| 5,042,675 | 8/1991 | Patterson | 220/207 |
| 5,117,999 | 6/1992 | Canzano et al. | 220/209 |

*Primary Examiner*—Joseph Man-Fu Moy

*Attorney, Agent, or Firm*—Roger L. May; Joseph W. Malleck

[57] ABSTRACT

A container (10) for compressed gas with a pressure relief member (18) made from a bimorph shape memory material. The bimorph (18) is impermeable by the gas. The bimorph (18) assumes a shape which changes depending on temperature. Below a critical temperature, the bimorph (18) lies in a first (deformed) state, and reverts to a second (remembered) state thereabove. The gas is entrapped within the container (10) when the bimorph (18) assumes the first state. When pressure rises due to temperature increase above the critical temperature, gas may escape from the container (10). This is because the bimorph (18) reverts to its second state, in which a relief gas passageway is opened, thereby relieving gas pressure.

20 Claims, 2 Drawing Sheets

COMPRESSED GAS CONTAINER WITH SHAPE MEMORY ALLOY PRESSURE RELIEF MEMBER

TECHNICAL FIELD

The present invention relates to containers of compressed gas and, more particularly, to a compressed gas container with a shape memory alloy pressure relief member.

BACKGROUND ART

The quest for alternative fuels, including natural gas, will result in compressed natural gas cylinders being found in cars and trucks with increasing frequency. Federally mandated regulations set forth various applicable safety standards. Those standards require that compressed natural gas containers include relief valving mechanisms which allow gaseous contents under pressure to escape from the container before reaching an unacceptably high pressure. Absent such relief mechanisms, the gaseous contents may become explosive, since the pressure of a fixed mass of gas is directly proportional to its temperature.

One approach to designing safety gas containers is disclosed in U.S. Pat. No. 4,660,7I4 which issued on Apr. 28, 1987. The '714 patent is incorporated herein by reference. It discloses the use of a valve member made of a shape memory alloy which is previously made to remember a smaller shape at a specific (high) transformation temperature. As the shape memory valve member is diminished in size in response to a rise in ambient temperature above the transformation temperature, a gap occurs between the valve member and the gas passageway, so the gas may escape before its pressure becomes unacceptably high. The '714 reference however is suitable only for low pressure applications, and is not well adapted to applications wherein pressures amounting to about 5,000 psi are exerted. This is because high internal pressures will keep the disclosed valve member seated and will not allow gas to escape. Additionally, the '714 disclosure contemplates allowing gas to escape at a small rate so as to avoid propelling the container.

Against this background, the need has arisen for a compressed gas container which serves as a safe reservoir that allows gas to escape whenever internal pressures rise above an unacceptable level.

Additionally, it would be desirable to take advantage of the unique thermo-mechanical properties of shape memory alloys which can be used as a suitable valving mechanism.

SUMMARY OF THE INVENTION

The present invention discloses a container for compressed gas. The container has a body portion which encapsulates the gas, and a neck portion in communication with the body portion. Defined within the neck portion is a gas passageway through which gas may escape from the container.

Mounted at the neck portion is a pressure relief member which is impermeable by the gas. The member is a bimorph which is formed from a shape memory material that has a shape which changes depending upon temperature. Below a critical (transformation) temperature, the bimorph assumes a first state. Above the critical temperature, the bimorph assumes a second state.

When the bimorph is in its first state, the gas is entrapped within the container. If gas pressure rises due to temperature increase above the critical temperature, the bimorph assumes its second state, thereby relieving gas pressure in the container by opening a gas passageway through which the gas may escape.

Accordingly, it is a general object of the present invention to provide a gas container with a pressure relief member made of a shape memory material having a wide range of thermal safety.

BEST MODES FOR CARRYING OUT THE INVENTION

Figure 1:
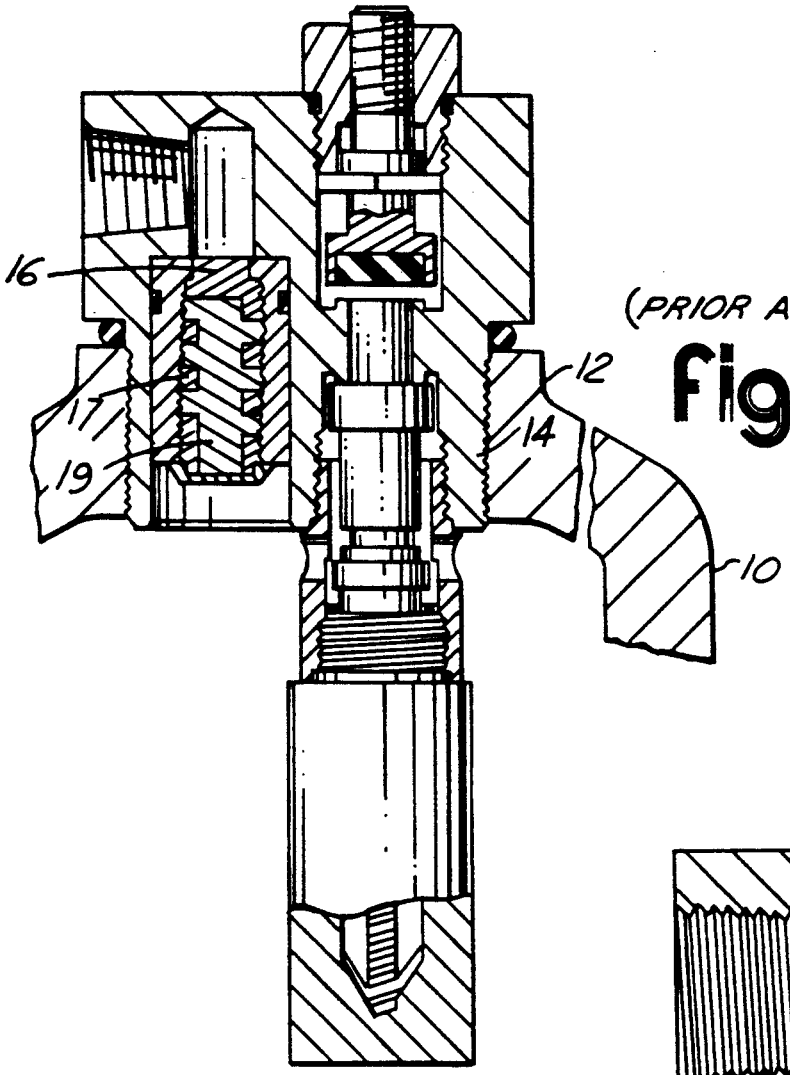
(PRIOR ART) Fig-1
FIG. 1 is a sectional view of a prior art container for compressed gas including a known pressure relief mechanism.

FIG. 1 illustrates a prior art approach to the problem of venting gas from compressed gas containers so as to avoid an unacceptably high, potentially explosive, pressure condition caused by high temperatures. The container 10 includes a body portion 12 which entraps the gas. A neck portion 14 is in communication with the body portion 12. Defined within the neck portion 14 is a gas passageway 16 through which the gas may escape from the container 10.

Pressure release mechanisms for compressed natural gas cylinders used in cars and trucks presently consist of an elaborate brass machined part 19 which is filled with a low melt temperature material 17. The material melts at a predetermined temperature. Pressure in the cylinder expels the melted material by extrusion through holes in the neck 14, thus relieving gas pressure. Such a device is expensive, and requires much space. Additionally, for large bottle sizes, one release device alone may not allow gas to escape rapidly enough. Accordingly, two or three pressure releases may be installed, which requires more space.

Figure 2:
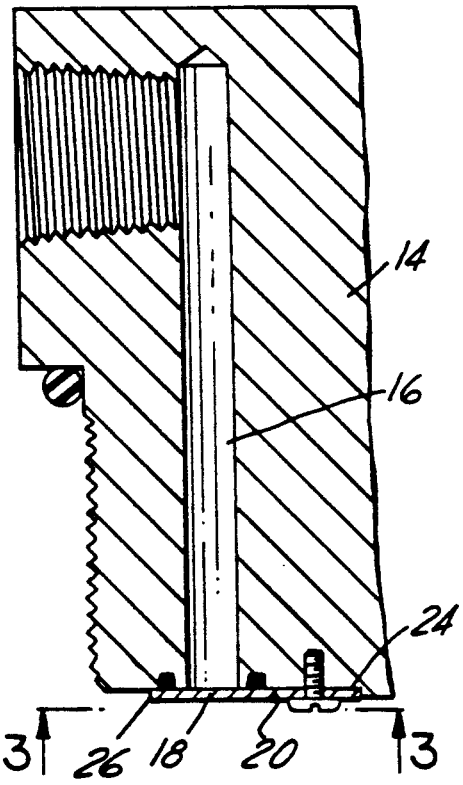
FIG. 2 is a cross-sectional view of part of a container for compressed gas having a pressure relief member according to the present invention, the pressure relief member including a bimorph made of a shape memory material in a first (closed) state.
Figure 2A:
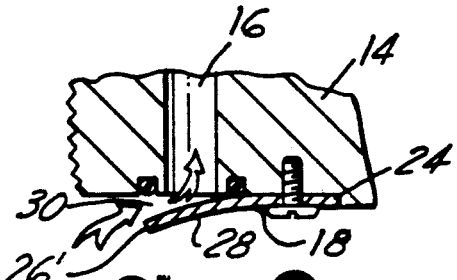
FIG. 2A is a cross-sectional view of part of the invention shown in FIG. 2, depicting the bimorph in a second (open) state.
Figure 3:
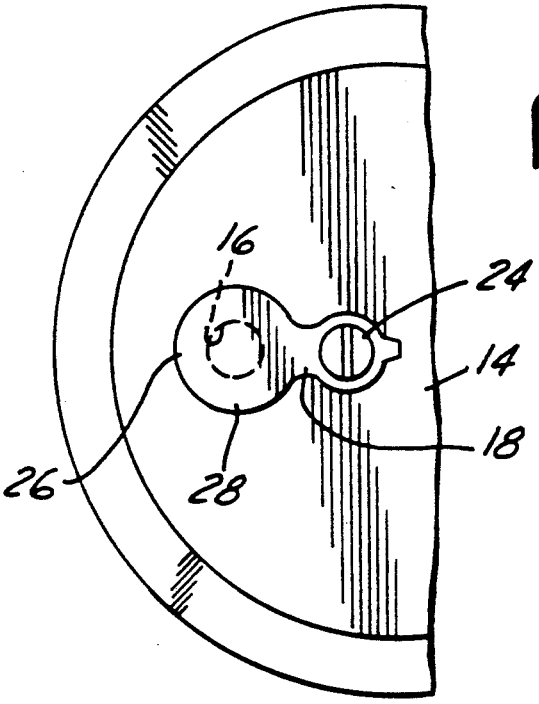
FIG. 3 is a view of the pressure relief member of the present invention taken in the direction 3—3 of FIG. 2.

Turning now to FIGS. 2, 2A and 3, there is depicted according to the present invention a pressure relief member 18. The member comprises a bimorph made of a shape memory material. Shape memory alloys exhibit the remarkable property of changing from a deformed shape to an original, remembered shape when exposed to an increase in temperature. The pressure relief member 18 is mounted at the neck portion 14 of the container 10. The bimorph is impermeable by entrapped gas.

With particular reference to FIG. 3, there is shown an anchored end 24, distal end 26, and center section 28 of the bimorph valve member 18. As illustrated, the distal end 26 and center section 28 overlie the gas passageway 16. The anchored end 24 is affixed to the underlying neck portion by conventional means, such as a pan head screw. Attached to the anchored end 24 is an angular extension which may serve as a locator for the bimorph 18. An O-ring may be seated in a groove below the center section 28, as illustrated in FIGS. 2 and 2A.

The shape memory material of which the pressure relief member 18 is formed has a shape which changes depending on temperature. Below a critical temperature, the bimorph assumes a first state. Above that temperature, the bimorph assumes a second state. FIG. 2 depicts the bimorph 18 in its first (closed) state, while FIG. 2A depicts the bimorph in its second (open) state.

When the bimorph 18 assumes its first state, gas is entrapped within the container. However, as is well known, the pressure of a fixed mass of gas is directly proportional to its temperature. In the present invention, if the temperature of the container 10 and/or its contents rises above a critical temperature, the bimorph 18 reverts to its second state. In that state, a deflection occurs (FIG. 2A), and a gap 30 is formed between the bimorph 18 and the neck portion 14 of the container 10. Accordingly, gas pressure in the container 10 is relieved.

Continuing with reference to FIGS. 2, 2A and 3, the bimorph 18 has an anchored end 24 secured to the neck portion 14 and a distal end 26 located opposite to the anchored end 24. A center section 28 (FIG. 2A) is located therebetween. When the bimorph 18 assumes its first state, the distal end 26 is seated (FIG. 2) on the neck portion 14 across the gas passageway 16 from the anchored end 24. In this way, the center section 28 seals the gas passageway 16 at pressures existing below the critical temperature.

With particular reference to FIG. 2A, at temperatures above the critical temperature, the distal end 26 is spaced from the neck portion 14 such that the distal end 26 and the center section 28 define a gap 30 between the bimorph 18 and the neck portion 14 when the bimorph assumes its second state. When the gap 30 is formed, gas may escape through the gas passageway 16 and relieve gas pressure in the container 10.

Before discussing the alternative embodiments depicted in FIG. 4, additional disclosure will now be made of the material from which the pressure relief member 18 is formed. The member 18 is made of a shape memory material and is defined herein as a "bimorph". This term signifies that the pressure relief member 18 may assume one of two shapes, depending upon its temperature. It is known that shape memory alloys (SMAs) exhibit the property of changing from a deformed shape to an original remembered shape when exposed to an increase in temperature through a critical transformation temperature. The present invention illustrates how the unique thermo-mechanical properties of SMAs can be harnessed into a practical, safe product.

The SMA disclosed herein is formed preferably from NiTi-based alloys. However, SMAs may also be formed from copper-based and iron-based materials. One unique property of the SMAs disclosed herein is that they can exhibit the desired deformation characteristics at temperatures up to about 100°-150° C. Additionally, such materials exhibit the optimum combination of strength, versatility, fatigue resistance and corrosion resistance.

The present application may operate at temperatures which exceed the critical (transformation) temperatures of the SMA material.

When the change from a deformed to an original remembered state occurs in response to an increase in temperature, the change can be dramatic and occur with a force sufficient to overcome high internal pressures generated within the container 10.

It is presently understood, without wishing to be bound by any particular theory, that the shape memory effect is associated with a crystallographically reversible, thermoelastic martensitic transformation. At temperatures below the transformation temperature, SMAs are relatively soft and can be deformed. At temperatures above the transformation temperature, their mechanical properties resemble steel. The present invention harnesses the attributes of shape changes which occur upon heating.

At temperatures below the critical temperature, the SMA material may be deformed to undergo a several percent strain under a relatively low stress. In temperature regimes above the critical temperature, the material reverts to its originally remembered state. The recoverable strain for one-way operation of Ni-Ti (Nitinol/Tinel) SMAs can be as high as 8%.

The bimorph 18 of which the pressure relief member is formed according to the present invention combines a sensing function with an actuating function, since it responds to a change in temperature by changing its shape, while generating a force sufficient to overcome gas pressure.

A wide variety of alloys exhibit the shape memory effect. Of commercial interest are SMAs capable of recovering substantial amounts of strain for generating sufficient force when changing shape to overcome the high pressure developed in the container. Copper-based alloys include Cu, Zn, Al, and Cu, Al, Ni. Ni-Ti alloys may have three-times the force and two-times the displacement capability of copper-based SMAs. Research on Fe-based alloys indicates that they may provide properties similar to Ni-Ti, but at a lower price.

The composition and temperature properties of SMA alloys that may be used in the present invention are listed in Table I.

TABLE I

| Alloy | Composition | Transformation Temperature Range - °C. |
|---|---|---|
| Au—Cd | 46.5/50 at % Cd | 30 to 100 |
| Cu—Al—Ni* | 14/14.5 wt % Al<br>3/4.5 wt % Ni | −140 to 100 |
| Cu—Zn—X<br>(X = Si, Sn, Al*) | a few wt % of X | −180 to 200 |
| In—Ti | 18/23 at % Ti | 60 to 100 |
| Ni—Al | 36/38 at % Al | −180 to 100 |
| Ni—Ti* | 49/51 at % Ni | −50 to 110 |
| Mn—Cu | 5/35 at % Cu | −250 to 180 |
| Fe—Mn—Si | 32 wt % Mn<br>6 wt % Si | −200 to 150 |

at % - atomic percent, wt %. * - commercial

Source: D. E. Hodgson, M. H. Wu and R. J. Biermann, "Shape Memory Alloys, ASM International Metals Handbook 10th Edition, Vol. 2, Properties & Selection: Nonferrous Alloys & Special-Purpose Materials, pp. 897-902 (1990).

As illustrated in Table I, Ni-Ti SMAS can be used up to an actuation temperature of about 110° C. If desired, Cu-based SMAS can be used to 200° C., should a lengthy excursion above that temperature be unlikely and if the environment is inert.

The SMA materials of which the present invention is made may be purchased from such suppliers as the Raychem Corporation (Menlo Park, Calif.).

Figure 4:
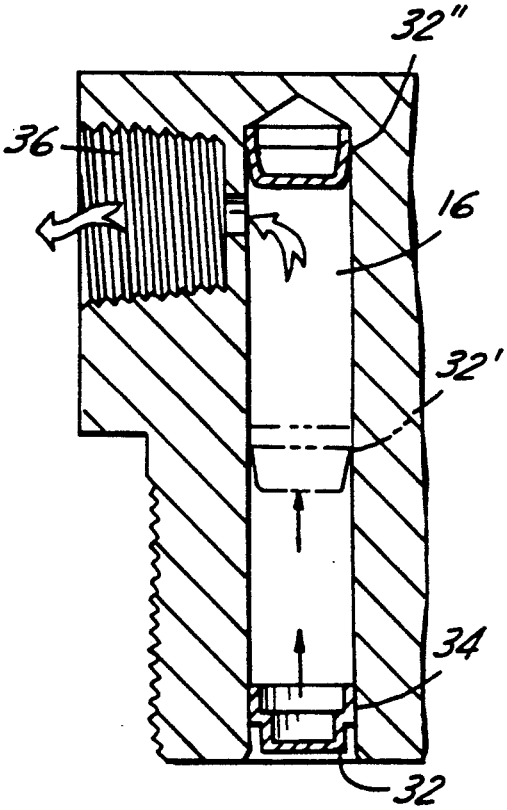
FIG. 4 is a cross-sectional view of part of a compressed gas container having a pressure relief member formed according to a first alternate embodiment of the present invention.

FIG. 4 depicts an alternate embodiment of the present invention. In this embodiment, the container 10 includes a cup-shaped base 32 which includes a stepped outside wall 34 that cooperates with the gas passageway when the bimorph 18 is in its first state. In that state, the cup-shaped base acts as a sealing member which blocks the passage of gas through the gas passageway 16. The outside wall 34 is sized such that when the bimorph 18 assumes its second state above the critical temperature, an outside diameter thereof shrinks. The cup-shaped member 32 may move under pressure through intermediate positions such as 32', to an end position 32". In that condition, the cup-shaped base 32 is urged by gas pressure to move along the gas passageway 16 past a venting port 36. After the cup-shaped base 32 moves to position 32", the venting port 36 is opened and is freely available as an escape path for gas under pressure.

The embodiments depicted in FIGS. 2–4 disclose a pressure relief member 18 which is effective in response to the temperature sensed. The embodiment of FIG. 5, however, depicts a pressure relief mechanism which is sensitive to temperature, or pressure, or both.

Figure 5:
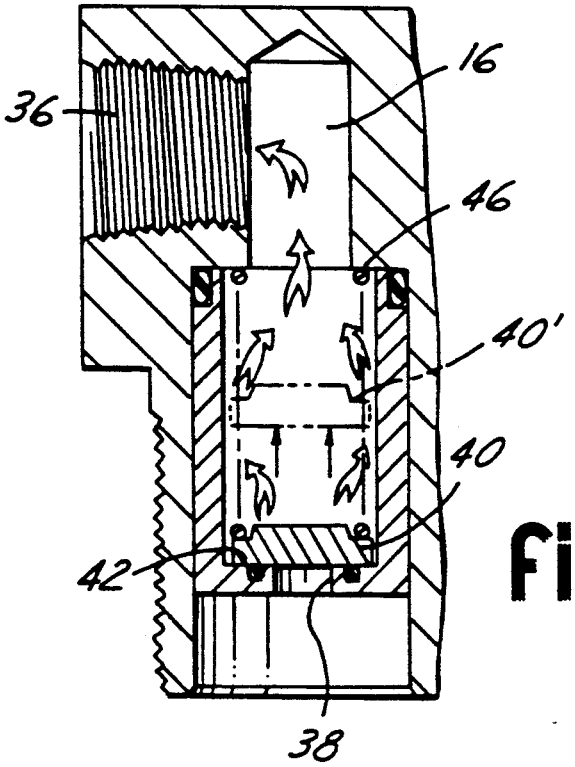
FIG. 5 is a cross-sectional view of part of a compressed gas container having a pressure relief member formed according to a second alternate embodiment of the present invention.

As depicted in FIG. 5, located at an entry to the gas passageway 16 is a throat portion 38. A piston 40 is seatable at the throat portion 38. The piston 40 may move axially along the gas passageway 16 through intermediate positions such as that depicted by the reference numeral 40'. When the piston 40 is seated at the throat portion 38, the gas passageway 16 is sealed. The piston 40 includes a shoulder portion upon which rests means for biasing 46, such as a helical spring. The spring 46 is made from an SMA material. Thus, when the piston 40 is at rest upon the throat portion 38, it is biased thereto under the influence of the spring 46.

The diameter of the piston 40 is less than that of the I.D. of the gas passageway 16. If the piston 40 rises through an intermediate position such as 40', gas may pass between the piston and the internal walls of the gas passageway 16. Such gas may ultimately escape through the venting port 36.

The embodiment of FIG. 5 offers some design flexibility because the pressure relief mechanism may be activated by pressure alone, temperature alone, or by a combination of pressure and temperature.

The pressure release mechanism may be activated by pressure alone below the critical temperature if the pressure in the container is sufficient to overcome closure forces exerted by the biasing means 46.

The pressure relief member formed by the spring 46, and if desired the piston 40, are made of an SMA material which is in its first (low temperature) state. Other things being equal, if the temperature in the container were to rise above the critical temperature, the spring 46 will revert to its second (high temperature) state. In that condition, internal pressures within the container will be relieved because the piston 40 will rise through the intermediate positions such as 40'. In such positions, gas may move between the piston 40' and the gas passageway, ultimately to escape through the venting port 36.

As noted earlier, an 8% dimensional deformation change may occur, depending upon the SMA material selected, when the SMA material transforms. During transformation, the forces generated are sufficient to overcome gas pressures developed in the container.

We claim:

1. A container for compressed gas, the container having a body portion which entraps the gas, a neck portion in communication with the body portion, the neck portion defining a gas passageway through which the gas may escape from the container, the container having:

a pressure relief member comprising a bimorph mounted at the neck portion, the bimorph being impermeable by the gas and comprising:

a shape memory material having a shape which changes depending on temperature, such that below a critical temperature the bimorph assumes a first state and above the critical temperature the bimorph assumes a second state, the gas being entrapped within the container when the bimorph assumes the first state, the gas escaping through the gas passageway when the pressure thereof rises due to temperature increase above the critical temperature when the bimorph assumes the second state, thereby relieving gas pressure in the container.

2. The container of claim 1, the bimorph having:

an anchored end secured to the neck portion, a distal end located opposite to the anchored end, and a center section situated therebetween, the distal end being seated on the neck portion across the gas passageway from the anchored end when the bimorph assumes its first state, so that the center section seals the gas passageway at pressures below the critical temperature.

3. The container of claim 1, the bimorph having:

an anchored end secured to the neck portion, a distal end located opposite to the anchored end, and a center section situated therebetween, the distal end being spaced from the neck portion, such that the distal end and the center section define a gap between the bimorph and the neck portion when the bimorph assumes its second state, so that gas may pass through the gap and escape through the gas passageway and relieve gas pressure in the container.

4. The container of claim 1, the bimorph having:

a cup-shaped base including an outside wall which cooperates with the gas passageway when the bimorph is in its first state, the outside wall being sized such that when the bimorph assumes its second state, an outside diameter of the wall shrinks and the cup-shaped base is urged by gas pressure to move along the gas passageway past a venting port, thereby allowing gas pressure to be relieved by gas flow through the gas passageway and the venting port.

5. The container of claim 1, further including:

a throat portion located at an entry to the gas passageway;

a piston which is adapted to move axially along the gas passageway from a sealing position in which the piston is seated at the throat portion and blocks the passage of gas along the gas passageway, to a venting position in which the gas may flow through the throat portion, around the piston and along the gas passageway; and means for biasing the piston towards the sealing position, the biasing means exerting a force which is overcome if the gas pressure rises above the acceptable level.

6. The container of claim 5, wherein the means for biasing comprises a shape memory material, the biasing means exerting a sealing force in the first state and a venting force in the second state, so that gas pressure may be relieved by a change from the first state to the second state of the bimorph or by the venting force being overcome by gas pressure in the first state of the bimorph.

7. The container of claim 6, wherein the piston comprises a shape memory material.

8. The container of claim 1 wherein the neck portion defines a plurality of gas passageways, each gas passageway having associated therewith a bimorph mounted at an associated neck portion.

9. The container of claim 1 wherein the bimorph is made from a Ni-Ti alloy.

10. The container of claim 1 wherein the bimorph is made from an Au-Cd alloy.

11. The container of claim 1 wherein the bimorph is made from a Cu-Al-Ni alloy.

12. The container of claim 1 wherein the bimorph is made from a Cu-Zn-X alloy, where X is Si, Sn or Al.

13. The container of claim 1 wherein the bimorph is made from an In-Tl alloy.

14. The container of claim 1 wherein the bimorph is made from a Ni-Al alloy.

15. The container of claim 1 wherein the bimorph is made from a Mn-Cu alloy.

16. The container of claim 1 wherein the bimorph is made from a Fe-Mn-Si alloy.

17. A container for compressed gas, the container permitting the gas to escape at an elevated temperature, the container having:

a pressure relief member comprising a bimorph made of a shape memory alloy, the bimorph being fitted proximate a gas passageway of the container;

wherein the shape memory alloy is previously made to remember a first state below a critical temperature; and the bimorph alters its shape to a second state above the critical temperature in response to a rise in ambient temperature above the critical temperature so that a gap occurs between the bimorph and the gas passageway and gas pressure may thereby be relieved.

18. A method for providing pressure relief in a container for compressed gas, the container having a gas passageway through which the gas may escape, the method comprising the steps of:

providing a pressure relief member having a bimorph mounted proximate the gas passageway, the bimorph being impermeable by the gas;

forming the bimorph so that it may assume a first state below a critical temperature and a second state thereabove, the gas being entrapped within the container when the bimorph assumes the first state; and selecting the material of which the bimorph is made so that at temperatures above the critical temperature, when the bimorph is in its second state, the bimorph is deflected and the gas passageway is thereby opened, such that the gas may escape through the gas passageway when the pressure thereof rises due to temperature increase above the critical temperature and gas pressure in the container may be relieved.

19. The method of claim 18 wherein the bimorph is made from a Ni-Ti alloy.

20. The method of claim 18 wherein the bimorph is made from a copper-based alloy.

* * * * *